US006560812B1

(12) United States Patent
Pettway

(10) Patent No.: US 6,560,812 B1
(45) Date of Patent: May 13, 2003

(54) BIRDIE BAG

(76) Inventor: Henry Aaron Pettway, 7036 Riverhill Dr., Riverdale, GA (US) 30274

( * ) Notice: Subject to any disclaimer, the term of this patent is extended or adjusted under 35 U.S.C. 154(b) by 178 days.

(21) Appl. No.: 09/793,716

(22) Filed: Feb. 20, 2001

Related U.S. Application Data

(60) Provisional application No. 60/231,228, filed on Sep. 8, 2000.

(51) Int. Cl.[7] ..... A63B 47/04

(52) U.S. Cl. ..... 15/210.1; 15/104.93; 15/209.1; 206/315.9; 224/919

(58) Field of Search ..... 15/21.2, 104.93, 15/209.1, 210.1; 206/315.9; 224/919

(56) References Cited

U.S. PATENT DOCUMENTS

| | | | | | |
|---|---|---|---|---|---|
| 2,530,746 | A | * | 11/1950 | Wetherby | 15/210.1 X |
| 2,968,825 | A | * | 1/1961 | Wetherby | 15/21.01 X |
| 3,806,983 | A | * | 4/1974 | Cunningham et al. | 15/210.1 X |
| 5,075,918 | A | * | 12/1991 | Zeltner et al. | 15/210.1 |
| 5,147,703 | A | * | 9/1992 | Provost et al. | 15/209.1 X |
| 5,770,284 | A | * | 6/1998 | Logemann | 15/210.1 X |
| 6,226,827 | B1 | * | 5/2001 | English, Jr. | 15/210.1 X |

FOREIGN PATENT DOCUMENTS

| | | | | |
|---|---|---|---|---|
| GB | 8536 | * | 5/1905 | 15/21.2 |
| GB | 7955 | * | 1/1915 | 15/21.2 |

* cited by examiner

*Primary Examiner*—Mark Spisich

(57) ABSTRACT

A golf ball cleaning device having a bag for cleaning golf balls, a club clasp for attaching and detaching the bag to and from the putter, an extension cable to connect the club clasp and cleaning bag and a detachable towel to wipe or dry the ball after cleaning it.

1 Claim, 4 Drawing Sheets

BIRDIE BAG

CROSS REFERENCE TO RELATED APPLICATION

This application claims benefit of provisional application No. 60/231,228, filed Sep. 8, 2000.

BACKGROUND OF THE INVENTION

The purpose of the concerned invention is to provide the golfer with a means of cleaning a golf ball after hitting the approach shot and prior to putting. The concerned invention is also used to clean golf balls when lift, clean and place rules are in effect.

At present time there is no ball cleaning device which allows a golfer to thoroughly clean a golf ball while in the fairway during lift, clean and place rules or prior to putting when on the green. Golfers typically use towels, rags and in some case their shirts or trousers to remove debris from their golf ball when faced with either situation. Either method is not terribly effective.

There are golf ball cleaners located on most golf courses that in all likelihood could outperform the concerned invention. However they are located near the teeing area and are stationary. Having these stationary ball cleaners at places other than the teeing area would be expensive and impractical since there is no way of knowing where they would be needed.

BRIEF SUMMARY OF THE INVENTION

The concerned invention addresses the need of thoroughly cleaning a golf ball prior to putting and during lift, clean a place rules. The invention hereafter referred to as "The Birdie Bag" is a portable, durable, inexpensive, self-contained golf ball cleaner. It is kept in the golfer's bag and can be used at the golfers discretion. Its outer skin is made of durable but pliable plastic to insure quality and longevity.

DETAIL DESCRIPTION OF THE INVENTION

Figure 1:
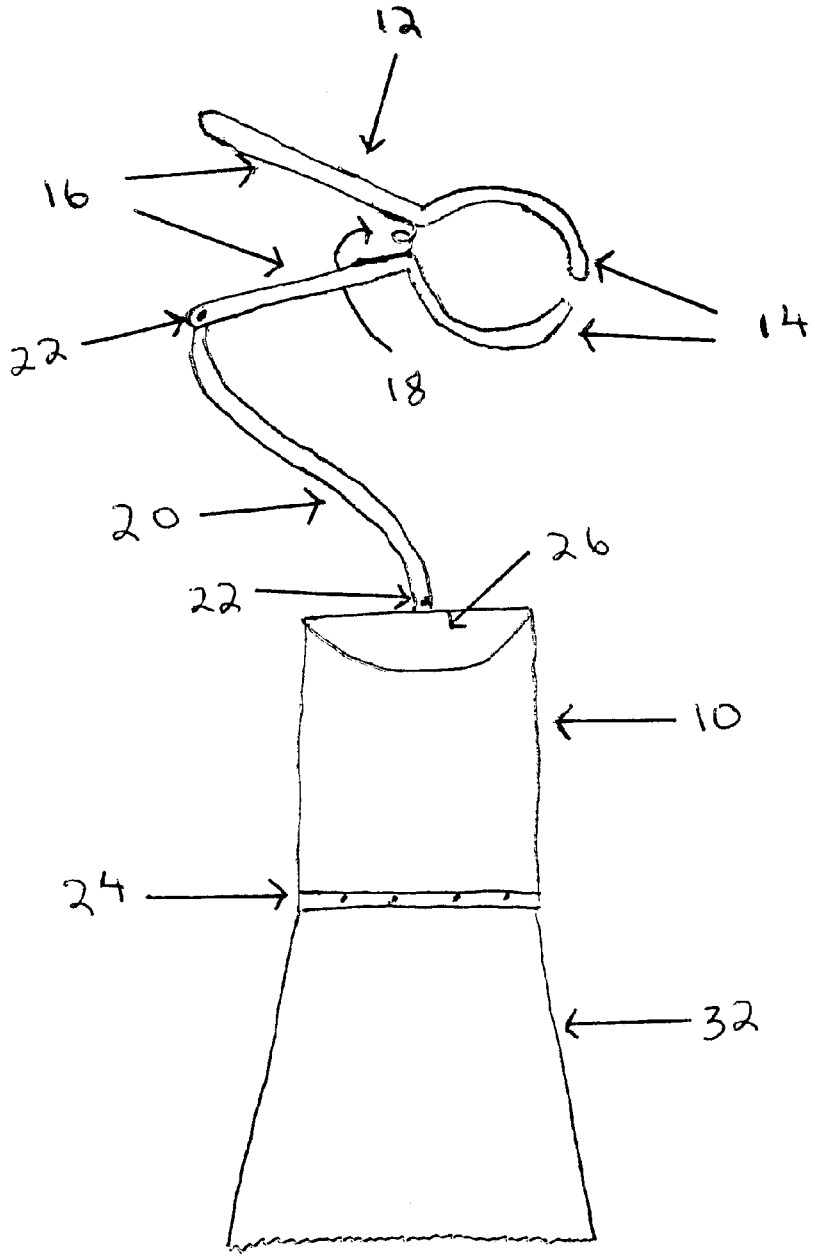
FIG. 1. Shows the club clasp in its secured or attached position, extension cable and the cleaning bag with cover closed.
Figure 2:
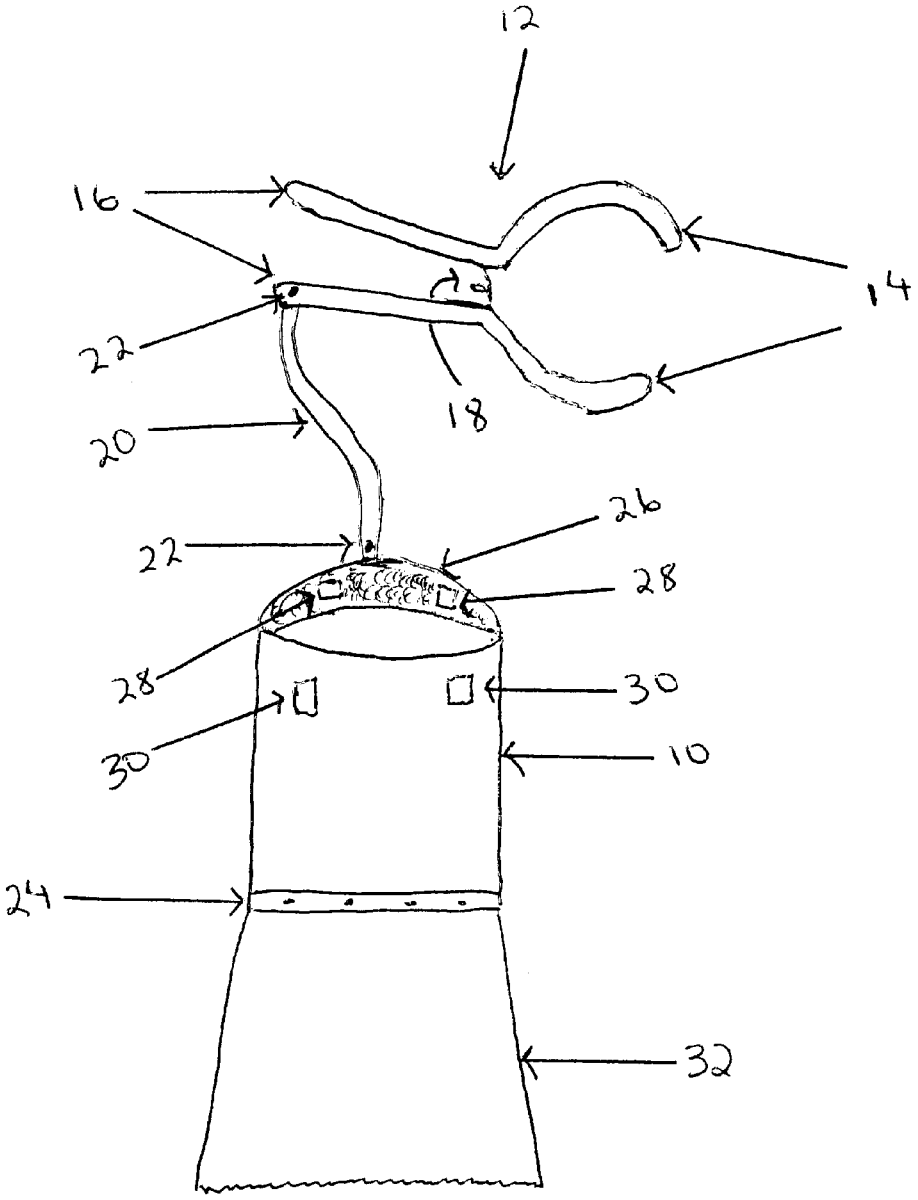
FIG. 2. Shows the club clasp in its open or detached position, extension cable and the cleaning bag with cover opened.
Figure 3:
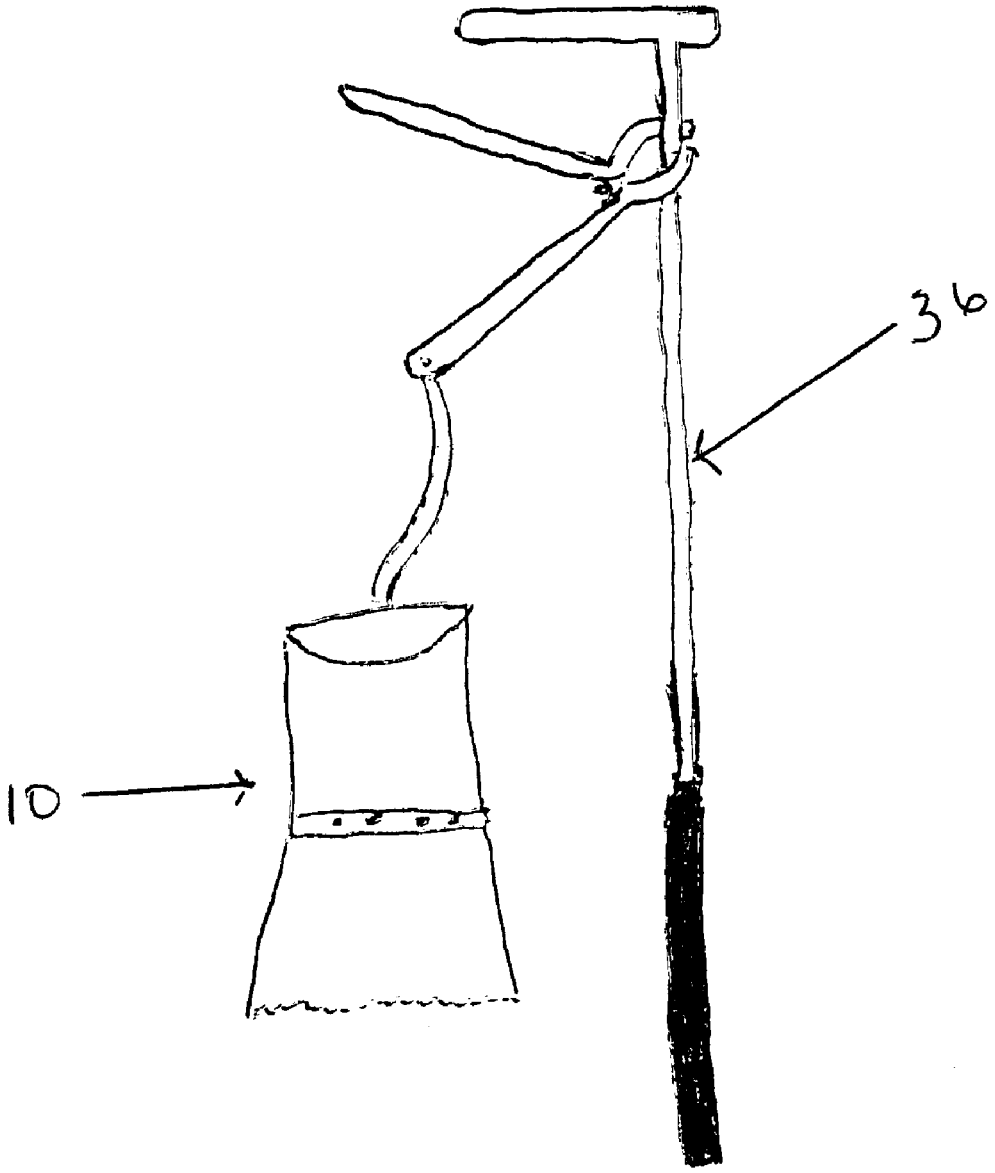
FIG. 3. Shows "The Birdie Bag" attached to the putter.
Figure 4:
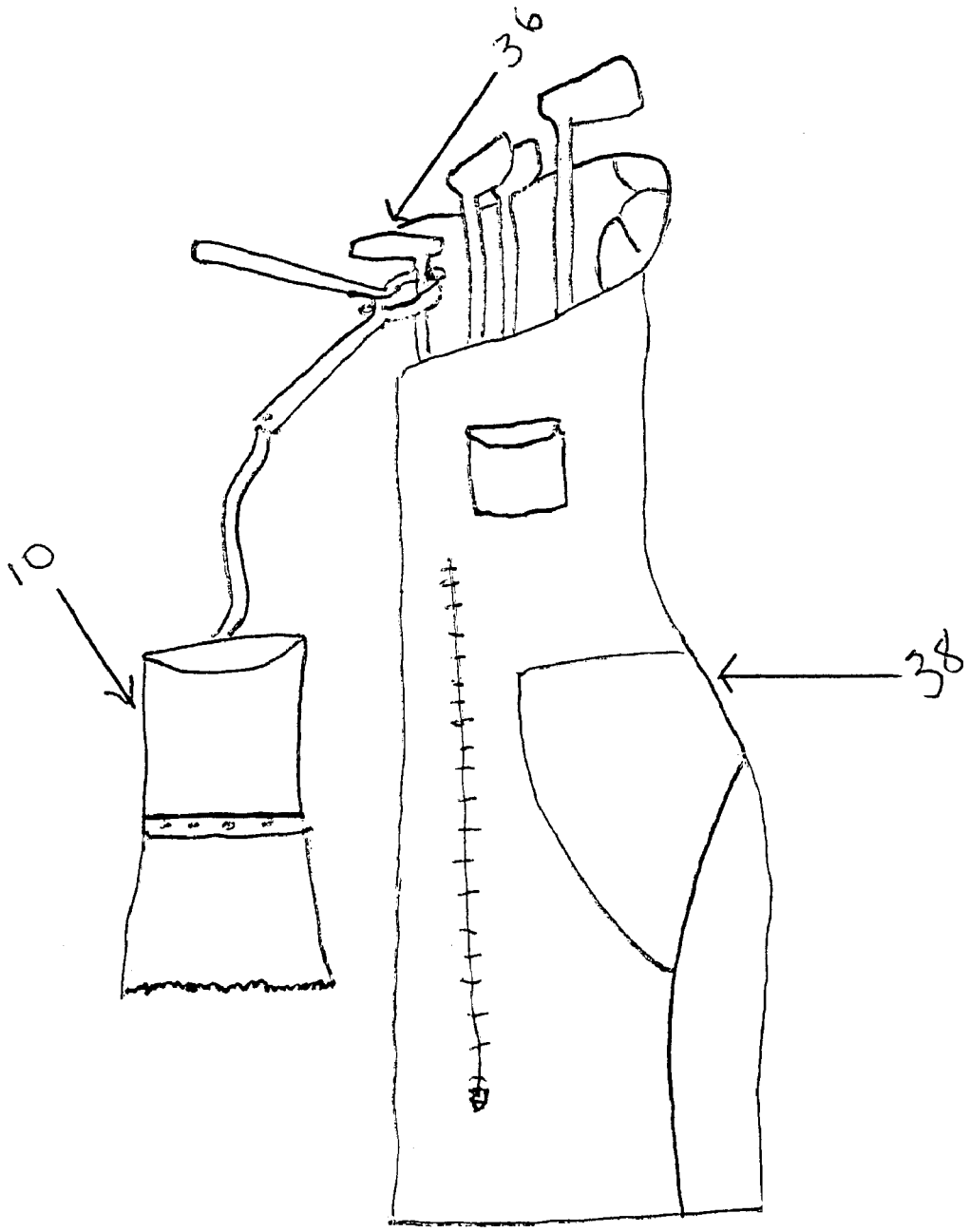
FIG. 4. Shows "The Birdie Bag" attached to the putter and hanging over the side of the golf bag.

The concerned invention is a portable device 10 for cleaning golf balls. It has 4 distinct parts connected to form the device called "The Birdie Bag." When not in used, the device 10 is attached to the putter shaft 36.

Part 1: The Club Clasp

The Birdie Bag 10 is secured to the putter by a "club clasp." The clasp 12 resembles and functions like a cloth pin. The clasping ends 14 of the clasp are concaved on both sides. The clasp is made of wood, plastic or metal. However the insides of the concaved ends are of wood, plastic or rubber. This keeps the clasping ends from scratching or otherwise damaging the putter shaft.

Function: The club clasp 12 is opened by squeezing the handles 16. This is done to remove The Birdie Bag from the putter. Squeezing the handles 16 also allows The Birdie Bag 10 to be reattached to the putter shaft. When the clasp 12 is attached to the putter, it is in its closed or secured position, To become closed, the tension spring 18 between the handles 16 closes the concaved ends 14 to a distance slightly smaller than the circumference of the putter shaft. The difference between the closed position of the club clasp and the circumference of the putter shaft causes the clasp to hold securely to the putter when attached.

Part 2: The Extension Cable

The extension cable 20 connects the club clasp 12 and the cleaning bag 24 together. It allows the cleaning bag 24 and towels 32 to hang over the side of the golf bag. The extension 20 is approximately 4 inches long and made of plastic covered steel cable, round nylon string or rope, plastic or leather. It is connected to the club clasp 12 and cleaning bag 24 by plastic or metal rivets or rings 22.

Part 3: The Cleaning Bag

The cleaning bag 24 is that portion of "The Birdie Bag" 10 composition actually used to clean golf balls. The bag 24 can accommodate at least 2 golf balls. It has enough room to maneuver a single golf ball up and down and side to side to facilitate cleaning. Approximate dimensions are 4 inches by 6 inches. The bag 24 is made of a 3-layer material with each layer having its own function.

1. The outer layer is made of soft, pliable, tear-resistant plastic. The purpose of this layer is to keep moisture inside and to keep the outside moisture free.
2. The middle layer is a sponge like material capable of absorbing and holding liquid. This layer will hold or house the moist cleaning solution use to clean the balls.
3. The inner layer is an abrasive, permeable and pliable material. This abrasive layer will be used to scrub debris from golf balls. Its permeability allows liquid from the middle layer to penetrate it and come into contact with the ball.

Together these layers form the substance of the cleaning bag 24. The layers are sewed, glued or fastened together so as not to come apart when in use. The color of the bag is preferably dark to help with moisture retention.

The cleaning bag 24 has a cover 26 made of the same 3-layer material as the bag 24. It has Velcro tabs 28 on its inside. The tabs 28 are revealed when the cover 24 is lifted. The Velcro tabs 28 inside the cover sticks to Velcro receptors 30 on the outside of the bag 24. The Velcro tabs 28 inside the cover 26 and outside the bag 24 are aligned to touch when the cover is closed.

Alternative closing methods: 1. A drawstring embedded in the bag opening 28. The string is drawn tight to close the bag and loosened to open it. 2. Metal or plastics snaps or Velcro attached to the inside of the bag opening. In either application, the bag is open by pulling the two sides of the opening apart and closed by pressing them together.

Part 4: Towel

The towel 32 attached to the cleaning bag 24 is used to dry or wipe the golf ball after cleaning it. It is attached with Velcro, metal or plastic fasteners 34. These methods of attachments allow removal of the towel for washing when needed. The towel is cotton or cotton blend and comes is any color. Preferred size is 1 ft by 2 ft.

Both cleaning bag and towel are printable. This allows courses, companies or indivisuals the opportunity to personalize their product.

Preferred Embodiment

The Birdie Bag 10 is secured to the putter 36 by a "club clasp." The clasp 12 resembles and functions like a cloth pin. The clasping ends 14 of the clasp are concaved on both sides so that they fit around the putter shaft. The clasp is made of rigid plastic and will not damage the putter shaft when attached. The tension spring 18 between the handles 16 is made of metal.

The clasp 12 is open by squeezing the handles 16. The tension spring 18 between the handles 16 closes it. When the clasp 12 is closed or in its secured position, the tension spring 18 closes the concaved ends 14 to a distance slightly smaller than the circumference of the putter shaft. The difference between the closed position of the club clasp and the circumference of the putter shaft causes the clasp to hold securely to the putter when attached.

A 4-inch extension cable 20 is attached to the club clasp 12 and the cleaning bag 24 (one end to the clasp and the other to the bag). The cable is connected to the 2 parts with rotational metals rivets 22. The extension cable is covered with plastic to prevent rust. It allows the cleaning bag to hang over the side of the golf bag 38, keeping it from obstructing other clubs.

The cleaning bag 24 is made of a 3-layer material with each layer having its own function.

1. The outer layer is made of soft, pliable, tear-resistant plastic. Its purpose is to keep moisture in the bag and the outside moisture-free.
2. The middle layer is a sponge like material capable of absorbing and holding liquids. Its function is to hold the moist cleaning solution.
3. The inner layer is an abrasive, permeable and pliable material. The abrasions are plastic and bristle like. This layer is used to scrub debris from golf balls.

Combined these materials form the cleaning bag 24. The layers are sewn together so as not to come apart when in use. The color of the bag is dark (black, green, red, blue or brown) to aid in moisture retention. The bag has cover 26 made of the same 3-layer material as the bag. The cover has Velcro tabs 28 on its inside. They are revealed when the cover is lifted. The Velcro tabs inside the cover sticks to Velcro receptors 30 on the outside of the cleaning bag when the cover is closed. The cleaning bag can accommodate at least 2 golf balls. Dimensions are 4 inches by 6 inches.

The towel 32 attached to the cleaning bag is cotton or cotton blend and is used to dry the golf ball after cleaning it. It is attached to the bottom of the bag with Velcro 34. This allows the towel to be removed when needed. It comes in any color.

How to Use The Birdie Bag

Bag Preparation: Open bag. Pour water, liquid soap and water mixture or other non-corrosive liquid cleaning solution into bag. Thoroughly soak inside of bag with solution. Turn bag upside down to discard excess solution. The Birdie Bag is now ready to use. Attached to putter with club clasp.

Using the Birdie Bag: Golfer hits approach shot to green. Removes putter with Birdie Bag attached from golf bag. Squeezes handles of club clasp to detach Birdie Bag from putter. Golfer then marks ball and places the ball inside The Birdie Bag and closes cover. Move ball up and down and side to side to loosen debris on the ball. When the ball is clean, it is removed from the bag and dried with attached towel. Golfer then replaces the ball, remove mark and putt the cleanest possible ball.

What is claimed is:

1. A golf ball cleaner comprising:

a bag having an opening at a top portion thereof, the bag comprised of an outer water impermeable material, an intermediate water absorbent material and an inner abrasive cleaning material whereby a ball my be placed in the bag and cleaned by manual manipulation by the user;

means for closing the bag opening;

a towel releasably secured to the bag;

an extension cable having first and second ends and wherein on of said ends of the cable is attached to the bag; and a clasp attached to the other end of said cable, the clasp comprising a pair of members each including a handle and facing concave ends with a tension spring therebetween for biasing the concave ends of the members in a closed position, whereby the ball cleaner may be secured to a golf club.

* * * * *